US005429307A

United States Patent [19]

Darroch

[11] Patent Number: 5,429,307

[45] Date of Patent: Jul. 4, 1995

[54] DUAL AIR SUPPLY SPRAY GUN

[75] Inventor: John B. Darroch, Carlsbad, Calif.

[73] Assignee: Apollo Sprayers International, Inc., Vista, Calif.

[21] Appl. No.: 253,591

[22] Filed: Jun. 1, 1994

Related U.S. Application Data

[63] Continuation of Ser. No. 75,792, Jun. 14, 1993, abandoned.

[51] Int. Cl.[6] ..... B05B 7/02

[52] U.S. Cl. ..... 239/390; 239/527

[58] Field of Search ..... 239/390, 525–527, 239/290, DIG. 14

[56] References Cited

U.S. PATENT DOCUMENTS

| | | | |
|---|---|---|---|
| 1,650,686 | 11/1927 | Binks | 239/527 X |
| 1,906,975 | 5/1933 | Larson | 239/527 X |
| 2,469,534 | 4/1949 | Wessels | 239/397 |
| 3,814,329 | 6/1974 | Clark | 239/526 X |
| 5,078,322 | 1/1992 | Torntore | 239/527 X |
| 5,279,461 | 1/1994 | Darroch | 239/526 X |

*Primary Examiner*—Andres Kashnikow
*Assistant Examiner*—Kevin P. Weldon
*Attorney, Agent, or Firm*—Walter A. Hackler

[57] ABSTRACT

A spray gun suitable for use with both high volume, low pressure (HVLP) air and compressed air sources for atomizing liquids includes a housing; a nozzle attached to said housing for controlling liquid flow therethrough; a high volume, low pressure air inlet and a compressed air inlet, both disposed in the housing. An air chamber is provided within the housing having sufficient volume to enable high pressure air introduced therein to expand to a pressure equivalent to the pressure of the high volume, low pressure air source; and a high pressure valve is provided for introducing air from the high pressure inlet into the air chamber.

10 Claims, 2 Drawing Sheets

DUAL AIR SUPPLY SPRAY GUN

This is a continuation of Copending application Ser. No. 08/075,792 filed on Jun. 14, 1993, now abandoned.

The present invention is generally directed to a spray gun and more particularly directed to a spray gun suitable for use with both high volume, low pressure (HVLP) air sources and conventional compressed air sources.

For many years, high pressure air, between about 20 psi to about 100 psi, has been utilized for atomizing liquids such as paint for spray painting.

This well-known system of high pressure air utilizes a low volume of air, e.g., about 10 cubic feet per minute, to atomize and disperse the liquid. Unfortunately, the use of high pressure spray systems has recently been severely limited by the Environmental Protection Agency because of the overspraying produced thereby; i.e., the amount of atomized particles into the air during application of paint to a surface has been deemed unacceptable.

To satisfy the need for spray painting, high volume, low pressure systems have been developed which utilize air pressures at a few psi up to 40 cubic feet per minute. The large volume of air passing contact with a liquid in a suitable nozzle causes atomization of the liquid. Importantly, an HVLP system has substantially reduced overspray and is currently acceptable to the Environmental Protection Agency.

Unfortunately, this newly-developed spray gun system requires an air turbine rather than an air compressor for supplying air to the gun. Therefore, users desiring to switch to an HVLP system are required to purchase not only the specially developed HVLP spray guns but also air turbines for providing air thereto.

Naturally, in the current transition period, a great number of air compressors are available which cannot be used with the newly designed HVLP spray guns.

The present invention provides a dual air supply spray gun based on HVLP nozzle principles which can be used with either an air turbine or a conventional compressed air source. This feature enables the use of old air compressors; yet, at the same time, it complies with the Environmental Protection Agency's standards for spray guns. As older air compressors are phased out of the work place, the dual air supply spray gun, in accordance with the present invention, maintains its usefulness through its unique capability of working with both air turbines and air compressors.

SUMMARY OF THE INVENTION

A spray gun suitable for use with both high volume, low pressure air and compressed air and sources for atomizing liquids, in accordance with the present invention, generally includes a housing, a nozzle attached to the housing, a means for defining a liquid outlet therein the nozzle, and a needle valve for controlling liquid flow therethrough.

A high volume, low pressure air inlet is provided and disposed in the housing, which includes means for coupling the high volume, low pressure air to a high volume, low pressure air source. A compressed air inlet is provided and also disposed in the housing which includes means for coupling the air inlet to a compressed air source.

Importantly, means are provided for defining an air chamber within the housing which has sufficient volume to enable high pressure air introduced therein to expand to a pressure equivalent to the pressure of the high volume, low pressure air source.

Because of the size of this air chamber, which is significantly greater than chambers found in prior art for compressed air spray guns, compressed air is able to expand and be delivered to the nozzle at sufficient volumes so that the nozzle, which is designed for the atomization of liquids utilizing high volume, low pressure air, is able to function.

More particularly, a high pressure valve provides means for introducing air from the high pressure inlet into the air chamber. In addition, means are provided for simultaneously operating the needle valve means and the high pressure valve means.

The housing may comprise a handle portion and a top portion with the high volume, low pressure inlet being disposed in the top portion and the high pressure inlet being disposed in the handle portion.

The means for simultaneously operating the needle valve means and the high pressure valve means may include a manually operable trigger, coupled to both the needle valve means and the high pressure valve means.

In describing the present invention with further particularity, means may be provided for selectively enabling only one of the high volume, low pressure inlet and the high pressure inlet to introduce air into an air chamber. This last-mentioned means may include a pair of caps each sized to separately seal the high volume, low pressure inlet and the high pressure inlet.

Thus, a simple removal and installation of a cap on either of the high volume, low pressure inlet or the high pressure inlet, enables a rapid switch from one air source to another air source. No dismantling, double spray gun, or structural rearrangement of the spray gun is necessary in order to switch from a high volume, low pressure air source to a high pressure air source.

As a result, the dual air supply spray gun, in accordance with the present invention, is suitable "off-the-shelf" for use with either HVLP air sources or compressed air sources. This unique feature provides incentive for paint spray operators to convert from high pressure spray systems to HVLP spray systems since all the HVLP equipment need not be purchased at one time.

It should be easily appreciated that, since the dual air supply spray gun in accordance with the present invention may be used with either the HVLP or the compressed air sources, significant economic savings may be achieved. Further, because the spray gun in accordance with the present invention may be readily switched for use with either HVLP and compressed air systems, the expected useful life in the marketplace is significantly enhanced.

BRIEF DESCRIPTION OF THE DRAWINGS

The advantages and features of the present invention will be better understood by the following description when considered in conjunction with the accompanying drawings in which.

DETAILED DESCRIPTION

Figures 1, 2:
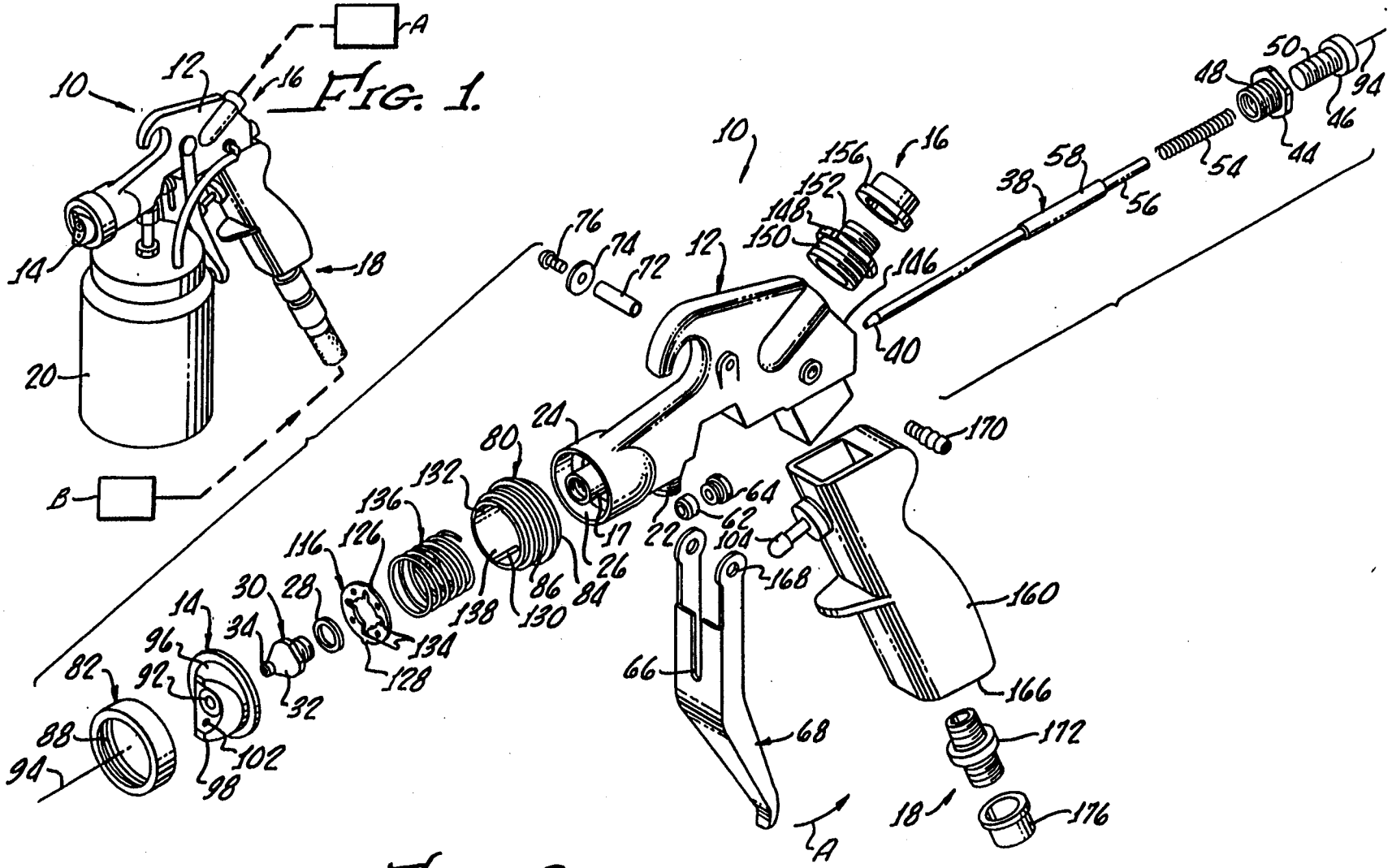
FIG. 1 is a perspective view of the spray gun in accordance with the present invention.
FIG. 2 is an enlarged, exploded perspective view of the spray gun in accordance with the present invention.

In FIG. 1, there is shown a spray gun 10 in accordance with the present invention suitable for use with both HVLP air and compressed air sources A, B for atomizing liquids. The spray gun 10 generally includes a housing 12; a nozzle 14; a high volume, low pressure air inlet 16 disposed in the housing; and a compressed air inlet 18. Also shown in FIG. 1 is a paint cup 20 which may be conventionally attached to the housing 12 by means of a fitting 22, as shown in FIG. 2.

It should be appreciated that while the paint cup 20 may be utilized as a means for providing atomizable liquid to the spray gun 10, any other means may be utilized, such as a tube (not shown) connecting the fitting 22 to a removable paint source (not shown). The cup 20 may be of any conventional design and adapted for connection to the fitting 22.

Figure 3:
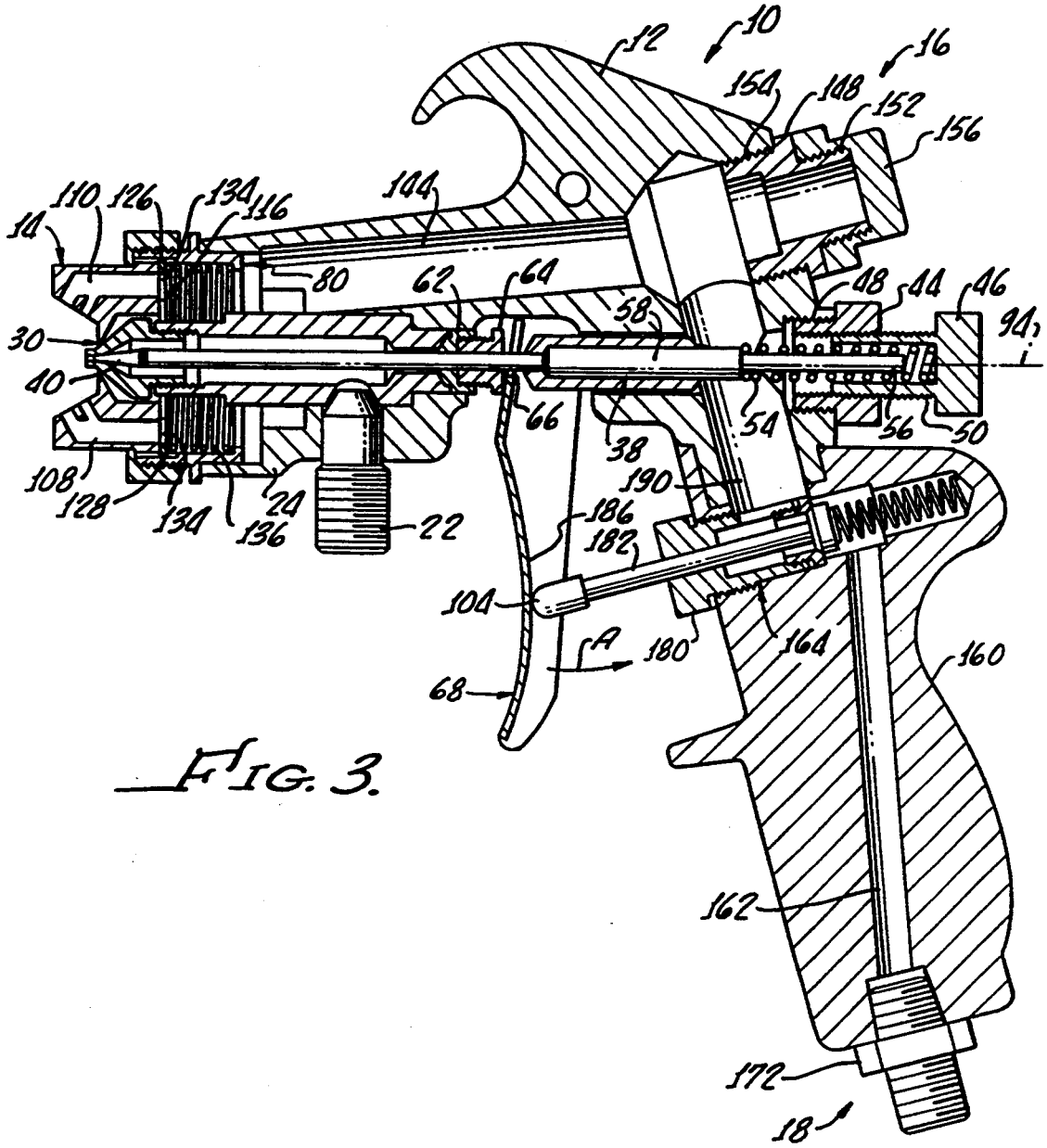
FIG. 3 is a cross-sectional view of the spray gun in FIG. 2.

More particularly, as shown in FIGS. 2 and 3, the housing 12 includes a circular front portion 24 which provides a means for defining an air chamber 26 which has a diameter suitable for enabling expansion of compressed air as will be hereinafter discussed. The air chamber 26 provides atomizing air to the nozzle 14.

Fitted to a liquid nozzle 17 through a gasket 28 is a nozzle tip 30 which provides means for defining a conical face 32 with a coaxial liquid outlet 34 therein, the outlet 34, nozzle tip 30 and liquid nozzle 16 being in fluid communication with the fitting 22 for passing paint, or the like, therethrough from the paint cup 20.

Flow through the liquid nozzle 17 is controlled by a needle 38 passing through the housing 12 and having a tip 40 sized for engagement with the nozzle tip 30 for both sealing of the outlet 34 and allowing a metered flow of liquid therethrough.

The needle 38 is supported in the housing 12 by means of a flow screw insert 44 and a flow adjusting screw 46, each fitted by threads 48 50 respectively to the housing 12 and flow screw insert 44. A needle spring 54 is sized to slip over a rear portion 56 for abutting a shoulder portion 58 in order to bias the needle 38 in a forward engaged relationship with the nozzle tip 30.

The needle 38 passes through a gland seal 62 and gland seal nut 64 which provides means for coupling the needle 38 to a slot 66 on a trigger 68 which may be mounted to the housing 12 via a trigger bushing 72, trigger screw washer 74 and trigger pivot screw 76. In operation, the engagement of the trigger slot 66 with the gland seal 62 and gland seal nut enables rearward motion of the needle 38 when the trigger is moved in the direction indicated by the arrow A in order to pass an atomizable liquid through the liquid nozzle 16 and outlet 34.

The spray nozzle 14 is fitted to the air chamber 26 by an air feed tube 80 and an air cap ring 82, each being provided with threads 84 86 88 for that purpose in a conventional manner. It should be appreciated that, when so fitted, the spray nozzle 14 is not rotationally fixed to the air chamber but is allowed to rotate in order to adjust the spray pattern as will be hereinafter described in greater detail.

As more clearly shown in FIG. 2, the spray nozzle 14 includes a central opening 92 for accepting the outlet 34 and enabling air to pass over the conical face 32 for atomizing engagement with liquid passing through the outlet 34.

In that regard, as best shown in FIG. 3, the central, or centered, opening 92 is subtended by a radially expanding frusto-conical surface, disposed at an angle with regard to the axis 94 for accepting the conical face 32 of the liquid nozzle tip 30. In addition, the spray nozzle 14 includes a pair of ears 96, 98, including pattern adjusting outlets 102.

A plurality of holes 108, 110 (see FIG. 2) communicate with the pattern adjusting outlets 102, 104, respectively, to a back face of the spray nozzle 14.

An air distributor 116 is disposed within the air chamber 26 and behind the spray nozzle 14 which provides means, in combination with the spray nozzle 14, for controlling the air flow to the air pattern adjusting outlets 102, 104 from the air chamber 26.

In addition to the holes 108, 110, the back face 114 of the spray nozzle 14 includes a plurality of indentations 120 and the air distributor plates 116 include a plurality of protrusions 122 which, in combination, provide a means for releasably engaging the spray nozzle 14 and the air distributor plate 116 at orientations therebetween for controlling the air flow through the holes 108, 110.

A pair of tabs 126, 128, sized for engagement with slots 130 132, in the air cap tube 80 (see FIG. 2) prevent rotation of the distributor plate 116 so that rotation of the air cap with respect thereto causes a change in the radial position of the pattern adjusting outlets about the coaxial liquid outlet 34, thereby providing different spray patterns (not shown) from the spray gun around the coaxial liquid outlet 94.

As part of the air chamber 26, an unobstructed air channel 144 may pass through the housing 12, which preferably has a diameter of at least one-half inch. This provides sufficient volume to enable high pressure air introduced therein to expand to a pressure equivalent to the pressure of high volume, low pressure air sources.

Thereafter, the air channel 144 extends from the air chamber 26 to a rear end 146 and is in communication with the HVLP inlet 16. The HVLP inlet 16 includes an insert 148 which provides means for coupling the HVLP inlet 16 to an HVLP air source (not shown) through an air supply tube (not shown) to be connected thereto by way of threads 152. When the HVLP source (not shown) is not utilized, the inlet 16 may be capped with an air plug 156.

The housing 12 may include a handle 160 which provides means for enabling hand support of the housing, and in addition a handle tube 162 may be inserted through the handle 160 for providing a connection between the high pressure inlet 18 and a high pressure valve 164. Alternatively, the handle 160 may be separable from the housing 12 and attached thereto in a conventional manner, such as a pin 170. The inlet 18 may include a fitting 172, attached to threads 174 to the tube 162, which provides a means for coupling the high pressure inlet 18 to a conventional compressed air source (not shown) through a tube (not shown). Fitting 172 may be a conventional quick release coupler, or a separate cap 176 may be provided for sealing the inlet 18 when it is not connected to the high pressure source.

In combination, the caps 156 and 176 provide a means for selectively enabling only one of the high volume, low pressure inlet 16 and the high pressure inlet 18 to introduce air into the air chamber 26.

FIGS. 2 and 3 show the high pressure valve 164, which may be of any conventional design, fitted to the handle 160 by means of a nut 180. A piston 182, having a head 104, bears against a back portion 186 of the trigger 68 which is hereinabove described as connected to the needle 38 and thereby provides a means for simultaneously opening a needle 38 and the high pressure valve 164.

Air introduced into an air chamber lower portion 190 from the valve 164 expands, because of the large size thereof, to a pressure approximately equivalent to HVLP pressures. It should be appreciated that prior art spray guns, particularly those developed for high pressure, do not include large air chambers, as is the case with the present invention. This important feature enables the use of the present invention spray gun 10 with a high pressure source.

It should also be appreciated that because of the large volumes of the air chamber, no separate valving of the HVLP air introduced through the inlet 16 is required.

Although there has been hereinabove described a specific arrangement of a spray gun in accordance with the present invention, for the purpose of illustrating the manner in which the invention may be used to advantage, it should be appreciated that the invention is not limited thereto. Accordingly, any and all modifications, variations, or equivalent arrangements which may occur to those skilled in the art, should be considered to be within the scope and the spirit of the present invention as defined in the appended claims.

What is claimed is:

1. A spray gun suitable for use with both high volume, low pressure (HVLP) air and high pressure air sources for atomizing liquids, said spray gun comprising:

a housing having a handle attached thereto;

a nozzle attached to said housing and having means for defining a liquid outlet therein and needle valve means for controlling liquid flow therethrough;

a high volume, low pressure air inlet passage disposed in said housing, said low pressure air inlet passage having a diameter sized to receive low pressure air at a pressure less than about 10 psi;

a high pressure air inlet passage disposed in said housing handle, said high pressure air inlet passage having a diameter sized to receive air at a pressure greater than about 20 psi;

means for defining an air chamber, within said housing, having a diameter at least twice the diameter of the high pressure air inlet passage and approximately equal to the diameter of the low pressure air inlet passage; and high pressure valve means for introducing air from the high pressure inlet passage into the air chamber.

2. The spray gun according to claim 1 wherein said housing comprises a handle portion and a top portion, said low pressure air inlet passage being disposed in said top portion and said high pressure inlet passage being disposed in said handle portion.

3. The spray gun according to claim 2, wherein said air chamber comprises a depending lower portion and said high pressure valve means is disposed between said high pressure air inlet passage and said depending lower portion for expanding air from the high pressure air inlet passage into said depending lower portion.

4. The spray gun according to claim 3 wherein the air channel diameter is at least about one-half inch and the high pressure inlet passage is at most about one-quarter inch.

5. A spray gun suitable for use with both high volume, low pressure (HVLP) and high pressure air sources for atomizing liquids, said spray gun comprising:

a nozzle having means for defining a liquid outlet therein and needle valve means for controlling liquid flow therethrough;

a housing having means, defining an air chamber, for providing atomizing air to said nozzle and a handle;

a high volume, low pressure air inlet disposed in said housing and communicating with said air chamber and including means for coupling the high volume low pressure air inlet to a high volume, low pressure air source with a pressure less than about 20 psi;

a high pressure air inlet disposed in said housing and including means for coupling the compressed air inlet to a high pressure air source;

high pressure valve means for introducing air from the high pressure inlet into the air chamber, the introduced air expanding within the air chamber to a pressure equivalent to the pressure of the high volume, low pressure air source; and a narrow high pressure tube disposed in said handle and interconnected between said high pressure air inlet and said high pressure valve means for accepting high pressure air between about 20 psi and about 100 psi.

6. Spray gun apparatus comprising:

a high volume, low pressure (HVLP) source of air at a pressure of less than about 10 psi;

a high pressure air source of air at a pressure of greater than about 20 psi;

a housing having a handle attached thereto;

a nozzle attached to said housing and having means for defining a liquid outlet therein and needle valve means for controlling liquid flow therethrough;

a high volume, low pressure air passage disposed in said housing, said low pressure air passage having a diameter sized to receive low pressure air at a pressure less than about 10 psi;

means for coupling the high volume, low pressure air inlet passage to the high volume, low pressure air source;

a high pressure air inlet passage disposed in said housing handle, said high pressure air inlet passage having a diameter sized to receive air at a pressure greater than about 20 psi;

means for coupling the high pressure air inlet to a high pressure air inlet passage to a high pressure air inlet to the high pressure air source;

means for defining an air chamber within said housing having a diameter substantially greater than the diameter of the high pressure air inlet passage and approximately equal to the diameter of the low pressure air inlet passage; and high pressure valve means for introducing air from the high pressure inlet passage into the air chamber.

7. The spray gun according to claim 6 wherein the diameter of the high volume, low pressure air inlet passage and the diameter of the air chamber are each at least twice the diameter of the high pressure air inlet passage.

8. The spray gun according to claim 7 wherein said housing comprises a handle portion and a top portion, said high volume low pressure inlet passage being disposed in said top portion and said high pressure inlet passage being disposed in said handle portion.

9. The spray gun according to claim 8 wherein said air chamber comprising a depending lower portion having a diameter substantially greater than the diameter of the high pressure air inlet passage and said high pressure valve means is disposed between said high pressure air inlet passage and the air chamber lower portion for expanding air from the high air chamber lower portion.

10. The spray gun according to claim 9 wherein the air channel diameter is at least about one-half inch and the high pressure inlet passage is at most about one-quarter inch.

* * * * *